United States Patent [19]

Vydrin et al.

[11] 4,198,841

[45] Apr. 22, 1980

[54] ROLL MILL STAND

[76] Inventors: Vladimir N. Vydrin, ulitsa Timiryazeva, 28, kv. 27; Leonid A. Barkov, ulitsa Klary Tsetkin, 30-a, kv. 13; Valery V. Pastukhov, ulitsa Stalevarov, 28-a, kv. 79; Vladimir A. Matveev, ulitsa Rossiiskaya, 32, kv. 1, all of Chelyabinsk; Pulat S. Maxudov, ulitsa Metallurgov, 9, kv. 4; Nikolai N. Sergeev, ulitsa Metallurgov, 5, kv. 4, both of Chirchik; Vladimir S. Mebel, ulitsa Chaplygina, 5, kv. 2, Tula; Erik V. Pravednikov, ulitsa Metallurgov, 71, kv. 79, Tula; Efim M. Rabinovich, ulitsa Metallurgov, 37, kv. 35, Tula; Valery K. Ushakov, ulitsa Chaplygina, 6, kv. 27, Tula, all of U.S.S.R.

[21] Appl. No.: 927,613

[22] Filed: Jul. 24, 1978

[30] Foreign Application Priority Data

Jul. 26, 1977 [SU] U.S.S.R. ..... 2519907[I]

[51] Int. Cl.[2] ..... B21B 31/10; B21B 31/20; B21B 31/18

[52] U.S. Cl. ..... 72/224; 72/237; 72/238; 72/247

[58] Field of Search ..... 72/224, 237, 238, 247, 72/234

[56] References Cited

U.S. PATENT DOCUMENTS

| | | | |
|---|---|---|---|
| 3,360,974 | 1/1968 | Purvance | 72/224 |
| 3,439,519 | 4/1969 | Gerding | 72/225 X |
| 3,628,594 | 12/1971 | Reinfeld | 72/245 |
| 3,818,742 | 6/1974 | Maltby et al. | 72/238 |

*Primary Examiner*—Milton S. Mehr
*Attorney, Agent, or Firm*—Fleit & Jacobson

[57] ABSTRACT

A roll mill stand has a supporting frame which mounts two housings with at least three work rolls being arranged therebetween, the geometric center lines of the rolls being located in a single plane and set one with respect to another to form a pass. The work rolls are mounted each in a respective shell, the latter being hinged upon one of the housings by a pivot secured in the housing parallel to the work roll and connected to the other housing by a screw-down mechanism intended to adjust the radial gap between the work rolls. At least one of the shells is supported by the respective pivot connecting the shell to the housing, the gap between the work rolls being adjustable transversally with respect to the axis of rolling.

5 Claims, 6 Drawing Figures

ROLL MILL STAND

BACKGROUND OF THE INVENTION

1. Field of the application

The present invention relates to rolling production, and more particularly, to roll mill stands.

The roll mill stands according to the present invention can most advantageously be employed in rolling mills for producing billets, sections and pipes from poorly plastic, hard-to-deform metals, such as, nickel, tungsten, molybdenum, their alloys and high-alloy grades of steel. These metals and alloys currently find an ever expanding field of application.

In plastic working, these materials feature a poor plasticity and a high resistance to deformation which exceeds by many times that of carbon steels.

Therefore, the rolling of these materials calls for the roll mill stands which create a favourable pattern of uniform compression deformations and possess a high loading capacity. In addition, said materials cover a wide range of grades and are used to manufacture many types and sizes of products, this necessitating frequent pass re-adjustments and roll changes in the process of operations, so that the roll mill stands are required to possess broad process potentialities.

2. Description of the Prior Art

There is known a roll mill stand with a four-roll pass. The known roll mill stand has four work rolls with axes thereof being set at 90° one with respect to another. These rolls are mounted in shells secured rigidly between two housings, all the rolls being live.

This roll mill stand is intended mainly to roll billets of a single size from ingots obtained in continuous casting machines and having a low plasticity. The pass, formed with four rolls, provides a favourable pattern of stressed state (uniform compression) which enhances the plasticity of the metal being rolled. In this roll mill stand, termed hereinafter simply stand, a wear of the working surface of rolls necessitates a complete disassambly of the stand, inclusive of the dismantling of shells with work rolls, for replacing the latter. This operation requires much time and labour and thus considerably lowers the efficiency of the stand.

In addition, there are known roll mill stands comprising a supporting frame which carries two housings, with two shell-mounted work rolls being arranged therebetween. Each shell is hinged upon one of the housings by means of a pivot parallel to the centre line of the work roll, and is secured in the other housing with the aid of a screw-down mechanism.

In these stands, the hinged connection of the shell to the housing permits the change of work rolls to be made by rotating the housing about a pivot set in the housing, whereas the fixing of the shell to the other housing by means of a screw-down mechanism makes it possible to adjust the radial gap between the rolls.

However, these stands are intended to roll thin sheets only.

SUMMARY OF THE INVENTION

It is therefore an object of the present invention to provide a roll mill stand wherein the work rolls will be so positioned as to make possible, without having to replace the rolls when their working surfaces are worn or the pass dimensions are to be changed, the adjustment of the distance between the work rolls both in the radials and in the transversal (with respect to the axis of rolling) directions.

Another object of the invention is to create a rolling mill of relatively small dimensions, but of broad process potentialities.

In accordance with these and other objects a roll mill stand is provided wherein a supporting frame carries two housings, with work rolls being arranged therebetween, each of said rolls being mounted in a respective shell, hinged upon one of the housings by means of a pivot that is set in the housing parallelly to the work roll and attached to the other housing with the aid of a screw-down mechanism intended to adjust the radial gap between the work rolls. According to the invention, the roll mill stand is provided with at least three work rolls, the geometric centre lines of which are located in a single plane and revolved one with respect to another to form a pass, at least one of the shells being mounted on a respective pivot connecting the shell for translational motion along said housing to adjust the distance between the work rolls in a direction transversal to the axis of rolling.

It is advantageous to control the motion of the shell with respect to the pivot coupling it to one of the housings by means of a screw of a nut-and-screw gearing, the screw being the threaded end of said pivot, with the nut acting upon the shell to thereby cause its motion.

This arrangement is simple in design, reliable in service and results in no excessive dimensions of the stand.

It is also advantageous to couple the pivot to the housing by means of a bushing placed coaxially with said pivot and having external and internal cylindrical surfaces eccentric one with respect to another, and of a device for locking said bushing in position with respect to the pivot and to the housing.

This type of coupling makes possible the adjustment of the distance between work rolls longitudinally of the axis of rolling, this improving the biting of a metal being rolled by pass-forming rolls of different diameters and by idle rolls, if such are provided in the pass.

The device for locking the bushing and the pivot in position with respect to the housing is preferably made in the form of a wedge connected to the nut-and-screw gearing and translationally movable, the bushing, the pivot and the housing being preferably provided with grooves for receiving said wedge.

Such structure of the device for locking the bushing and the pivot in the housing is most simple in design and results in no excessive dimensions of the stand.

It is expedient for the housings to be shaped substantially in the form of a star, the arm members thereof receiving the shells with the work rolls.

The housings shaped in this manner require the least amount of metal and are easy to manufacture.

The roll mill stand according to the invention possesses broad process potentialities, making possible a rapid pass re-adjustment through radial and axial motions of the work rolls, an optimum positioning of the work rolls along the axis of rolling to ensure an effective biting of a metal being rolled by the work rolls and a roll change without the disassembly of the stand. In addition, the stand is capable of withstanding large loads despite a relatively small size and is easy to manufacture.

BRIEF DESCRIPTION OF THE DRAWINGS

These and other objects and features of the invention become readily apparent from one embodiment thereof which will now be described by way of example with reference to the accompanying drawings, in which.

DESCRIPTION OF THE PREFERRED EMBODIMENT

Figure 1:
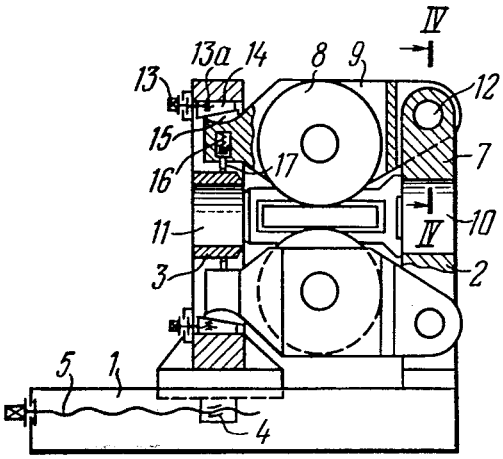
FIG. 1 is a diagrammatic side elevation with partial sections of a roll mill stand, according to the invention.
Figure 3:
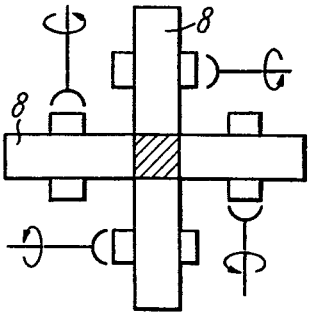
FIG. 3 is a diagrammatic view of the arrangement of the work rolls.
Figure 2:
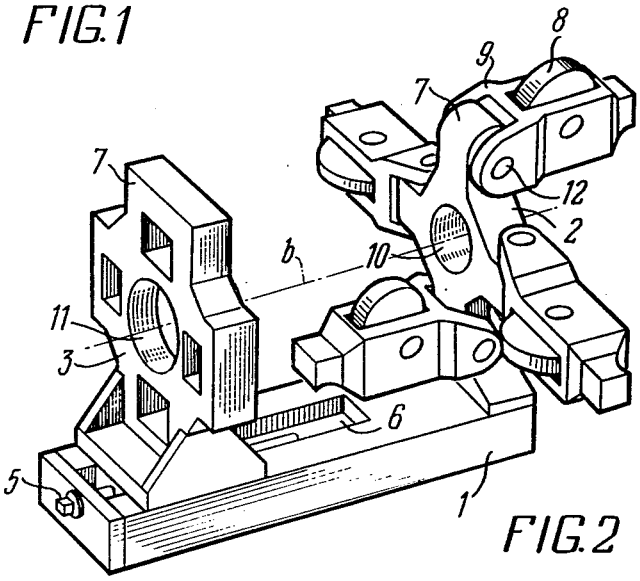
FIG. 2 is an exploded axonometric view of a roll mill stand with housings and shells with work rolls.

The roll mill stand of the invention is provided with a four-high pass and comprises a supporting frame 1 (FIGS. 1 and 2), which mounts a housing 2 and a housing 3. The housing 2 is fixed to the supporting frame 1, whereas the housing 3 is mounted on the supporting frame 1 for movement with respect to the latter, the housing 3 being geared to this end to a nut 4 set on a screw 5 located in a groove 6 (FIG. 2) provided in the supporting frame 1. The housings 2 and 3 are shaped substantially in the form of stars, as shown in FIG. 2. The number of arm members 7 on each frame is equal to that of work rolls 8, i.e., to four. The arm members 7 of the housings 3 and 2 are intended to accommodate shells 9 which carry the work rolls 8, the geometric axes thereof being located in a single plane and set at 90° one with respect to another (FIG. 3). The housings 2 (FIG. 2) and 3 are provided with orifices 10 and 11, respectively, for the passage of a metal being rolled.

The shell 9 (FIG. 1) of each work roll 8 is connected to the arm member 7 of the housing 2 by means of a pivot 12 set in parallel to the work roll 8 and to the housing 3 by a screw-down device which is intended to adjust the radial gap between the work rolls 8 and comprises a screw 13 set in the housing 3 and interacting with a nut 13*a* secured in a wedge 14 acting upon the shell 9 through the agency of a block 15 having a cylindrical surface. To ensure a permanent forcing of the shells 9 against the screw-down devices, each of the former incorporates a spring 16 and a rod 17 resting upon the housing 3.

Figure 4:
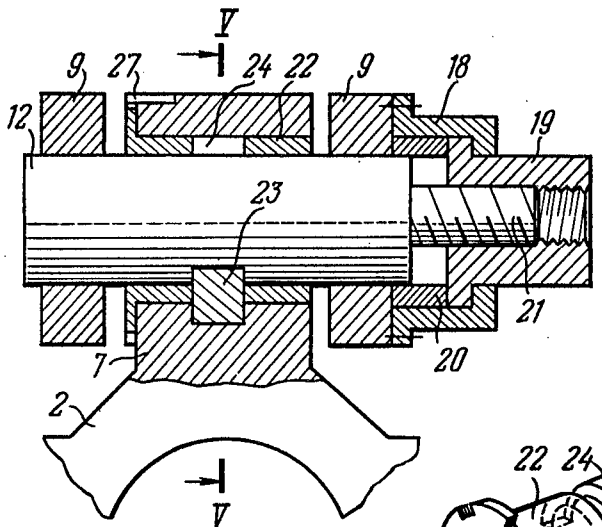
FIG. 4 is an enlarged scale section at IV—IV of FIG. 1.

To move the shell 9 with respect to the pivot 12, connecting the former to the housing 2, i.e., transversally with respect to the axis "b" of rolling, the shell 9 (FIG. 4) receives a flange 18 accommodating a nut 19. The nut 19 is prevented from moving longitudinally of the flange 18 by a bushing 20. The nut 19 interacts with a screw 21 which is the threaded end of the pivot 12.

Figure 5:
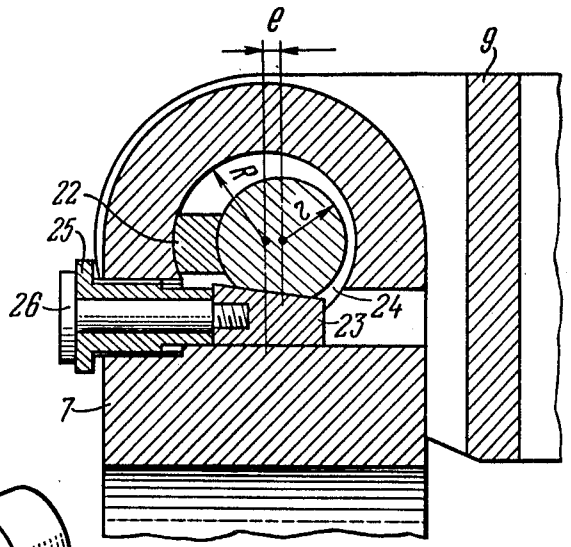
FIG. 5 is a section at V—V of FIG. 4.
Figure 6:
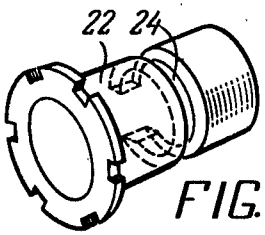
FIG. 6 is an axonometric projection view of the bushing.

To adjust the spacing of the work rolls 8 longitudinally of the axis "b" of rolling, the pivot 12 is coupled to the arm 7 of the housing 2 with the aid of a bushing 22 (FIG. 6) set coaxially with said pivot 12, with external and internal cylindrical surfaces of the bushing being offset through a distance "e" (FIG. 5) one with respect to another.

The bushing 22 and the pivot 12 (FIG. 4) are secured in the arm member 7 of the housing 2 by a device made in the form of a wedge 23 located in a groove 24 of the bushing 22 and in grooves provided in the pivot 12 and in the arm member 7. The wedge 23 is movable translationally by a nut-and-screw gearing. The screw 25 of said gearing interacts with a screw thread on the arm member 7 which thus serves as a nut. The screw 25 is secured in the wedge 23 by means of a bolt 26. The bushing 22 may additionally be locked in position with respect to the housing 2 by a key 27.

The bushing 22 may be locked in position with respect to the pivot 12 and the housing 2 by any other suitable means.

The roll mill stand according to the invention operates as follows.

Rolling is effected by a conventional method.

The position of the work rolls is adjusted in the manner described below.

The radial gap between the work rolls 8 is adjusted by a longitudinal movement of the wedge 14 with the aid of a screw 13 and a nut 13*a*, secured in said wedge. The block 15 compensates by respective cylindrical surface any misalignments which may arise on rotation of the shell 9 about the pivot 12. The shell 9 is permanently forced against the wedge 14 through the agency of the spring 16 and the rod 17 which rest upon the body of the housing 3.

The work rolls 8 can be re-positioned transversally of the axis of rolling by rotating the nut 19 which moves along the screw 21 of the pivot 12 to act upon the shell 9 with the work roll 8 and so to cause the shell 9 to move along the pivot 12 axially fixed in the housing 2.

A stable biting of a metal being rolled by the work rolls 8 can be ensured by providing a simultaneous contact of all the live rolls with the metal.

To this end, the wedge 23 is uncoupled from the pivot 12 by means of the screw 25, then the key 27 is removed and the bushing 22 is rotated. The rotation of the bushing 22 causes the motion of the pivot 12 parallelly to the axis "b" of rolling because the cylindrical surfaces of the bushing are eccentric. This motion positions the work rolls 8 in a manner to ensure an effective biting of the metal.

The work rolls 8 are changed in the stand by a procedure described below.

A rotation of the screw 5, which interacts with the nut 4, results in a motion of the housing 3 along the axis "b" of rolling until the shells 9 are uncoupled from the housing 3. The shells 9 are then brought apart by rotation about their pivots 12, and the work rolls 8 are finally dismantled by any conventional method.

The roll mill stand of the invention is assembled in a sequence opposite to the above.

An experimental specimen of a roll mill stand, according to the invention, has been manufactured and put through tests which indicated that the stand possesses a high load capacity notwithstanding its small size and features broad process potentialities which make the efficiency and the service performance of the stand greatly superior to the known roll mill stands.

We claim:

1. A roll mill stand comprising: a supporting frame; two spaced-apart housings mounted on said supporting frame in such manner that at least one of said housings is movable towards the other; means for moving said housings towards and away from each other; at least three work rolls arranged between said two housings, the geometric centre lines of the work rolls being located in a single plane and set at an angle one with respect to another so that said work rolls form a pass; at least three shells each accommodating a work roll of said at least three work rolls; each of said at least three shells being coupled to one of said two housings by a pivot secured in said housing parallel to the axis of the accomodated work roll; each of said at least three shells being coupled to the other of said two housings by movement of the housings; a screw-down mechanism associated with the other of said two housings for adjusting a radial gap formed between at least two of the work rolls; at least one of said three shells being mounted on a respective pivot which connects said shell to one of said two housings for movement along said pivot in order to adjust the distance between said at least three work rolls transversely of an axis of rolling; means for moving at least one of the three said shells relatively to its respective pivot; and means for rotating said work rolls.

2. A roll mill stand as claimed in claim 1, wherein the movement of a shell with respect to the pivot coupling said shell to one of the housings is effected by means of a nut-and-screw gearing, the screw thereof being the threaded end of the pivot, whereas the nut, as it moves, acts upon the shell to cause the latter to move.

3. A roll mill stand as claimed in claim 1, wherein the pivot is coupled to one of the housings by means of a coaxially arranged bushing with mutually eccentric external and internal cylindrical surfaces and of a device for locking said bushing in position with respect to the pivot and the housing.

4. A roll mill stand as claimed in claim 3, characterized in that the device for locking the bushing in position with respect to the pivot and to the housing is a translationally movable wedge coupled to the nut-and-screw gearing, the bushing, the pivot and the housing being provided with grooves for receiving the wedge.

5. A roll mill stand as claimed in claim 1, wherein the housings are substantially shaped as stars, the arm members thereof accomodating the shells with the work rolls.

* * * * *